US009927200B2

(12) United States Patent
Kuracina

(10) Patent No.: US 9,927,200 B2
(45) Date of Patent: Mar. 27, 2018

(54) TRIGGER MECHANICS FOR AUTO-LOADING FIREARM WITHOUT TRIGGER MOTION BAR WITH DIRECT CONTROL OF FIRING PIN CATCH THROUGH ONE-ARM TRIGGER LEVER

(71) Applicant: Grand Power, s.r.o., Banska Bystrica (SK)

(72) Inventor: Jaroslav Kuracina, Banska Bystrica (SK)

(73) Assignee: GRAND POWER, S.R.O., Banska Bystrica (SK)

( * ) Notice: Subject to any disclaimer, the term of this patent is extended or adjusted under 35 U.S.C. 154(b) by 0 days.

(21) Appl. No.: 15/155,916

(22) Filed: May 16, 2016

(65) Prior Publication Data

US 2016/0356568 A1 Dec. 8, 2016

(30) Foreign Application Priority Data

May 25, 2015 (SK) ..... 50027-2015

(51) Int. Cl.
*F41A 19/30* (2006.01)
*F41A 19/10* (2006.01)
*F41A 19/32* (2006.01)

(52) U.S. Cl.
CPC ..... *F41A 19/30* (2013.01); *F41A 19/10* (2013.01); *F41A 19/32* (2013.01)

(58) Field of Classification Search
CPC ..... F41A 19/00; F41A 19/10; F41A 19/11; F41A 19/13; F41A 19/24; F41A 19/25; F41A 19/27; F41A 19/31; F41A 19/32
USPC ..... 89/136, 144
See application file for complete search history.

(56) References Cited

U.S. PATENT DOCUMENTS 1,041,648 A * 10/1912 Mauser ..... F41A 19/31 42/70.06
1,382,313 A * 6/1921 Ortgies ..... F41A 19/12 89/145
2,249,231 A * 7/1941 Smith ..... F41A 19/16 42/69.02
2,249,232 A * 7/1941 Smith ..... F41A 19/16 42/69.02
2,405,798 A * 8/1946 Seitz ..... F41A 17/20 42/69.02
2,425,434 A * 8/1947 Loomis ..... F41A 19/13 89/132

(Continued)

FOREIGN PATENT DOCUMENTS

CZ 27296 U1 9/2014
FR 427556 A * 8/1911 ..... F41A 3/64

(Continued)

*Primary Examiner* — Derrick R Morgan
(74) *Attorney, Agent, or Firm* — Ohlandt, Greeley, Ruggiero & Perle, LLP

(57) ABSTRACT

The trigger mechanism is characterized by the lack of the trigger moving bar, which function is assigned to the trigger lever. The trigger lever is not fastened with the trigger by any connecting element. The mechanism is equipped with the manual and falling safeguard. With using of the manual safety catch the putting on the safety catch of the firearm, against the shot, is controlled by bifacially manipulable fingerboards without the need of any change in the construction of the firearm or the need of the change of the grip of the firearm.

7 Claims, 10 Drawing Sheets

(56) References Cited

U.S. PATENT DOCUMENTS 2,613,577 A * 10/1952 De Kiraly ..... F41A 3/38 89/149
3,584,533 A * 6/1971 Allyn ..... F41A 3/54 42/25
3,965,604 A 6/1976 Khaidurov et al.
4,825,744 A * 5/1989 Glock ..... F41A 5/04 89/145
4,932,148 A * 6/1990 Barrett ..... F41A 19/10 42/18
5,050,480 A * 9/1991 Knight, Jr. ..... F41A 5/06 42/7
5,157,209 A * 10/1992 Dunn ..... F41A 17/64 42/70.08
5,359,799 A * 11/1994 Moon ..... F41A 19/10 42/69.02
5,363,581 A * 11/1994 Blenk ..... F41A 19/31 42/69.02
5,438,784 A * 8/1995 Lenkarski ..... F41A 17/72 42/70.02
5,635,664 A * 6/1997 Pons ..... F41A 19/44 42/69.03
5,806,225 A * 9/1998 Gardner ..... F41A 19/35 42/69.02
6,070,512 A * 6/2000 Rohrbaugh ..... F41A 17/06 42/69.02
6,634,129 B1 * 10/2003 Freeman, Jr. ..... F41A 3/26 42/69.02
6,705,036 B2 * 3/2004 Orr ..... F41A 19/15 124/31
6,826,997 B1 * 12/2004 Kuracina ..... F41A 19/02 89/145
6,865,979 B1 * 3/2005 Vaid ..... F41A 17/72 42/90
7,500,327 B2 * 3/2009 Bubits ..... F41A 19/32 42/69.02
7,690,144 B2 * 4/2010 Fagundes de Campos ..... F41A 17/72 42/69.02
7,694,449 B1 * 4/2010 Pontillo, II ..... F41A 3/26 42/71.02
7,827,720 B1 * 11/2010 Erdem ..... F41A 17/42 42/70.01
8,033,043 B2 * 10/2011 McGarry ..... F41A 11/00 42/70.01
8,220,193 B1 * 7/2012 Lynch ..... F41A 17/48 42/70.08
8,490,309 B2 * 7/2013 Zukowski ..... F41A 19/10 42/42.03
8,505,225 B1 * 8/2013 Degener ..... F41A 19/10 42/69.01
8,555,539 B2 * 10/2013 Pflaumer ..... F41A 19/44 42/69.01
8,572,878 B2 * 11/2013 Gentilini ..... F41A 17/72 42/69.01
8,925,232 B2 * 1/2015 da Silveira ..... F41A 19/12 42/69.02
8,935,872 B2 * 1/2015 Zukowski ..... F41A 17/36 42/70.02
9,062,925 B1 * 6/2015 Viani ..... F41A 19/10
9,194,639 B1 * 11/2015 Malheiros ..... F41A 19/32
9,222,745 B2 * 12/2015 Kallio ..... F41A 17/72
9,347,726 B1 * 5/2016 Thomas ..... F41A 19/12
9,383,153 B2 * 7/2016 Nebeker ..... F41A 17/56
9,404,700 B1 * 8/2016 Viani ..... F41A 19/10
2003/0037666 A1 * 2/2003 Bero ..... F41A 19/32 89/9
2006/0236581 A1 * 10/2006 Viani ..... F41A 19/30 42/69.01
2008/0263926 A1 * 10/2008 Bubits ..... F41A 19/32 42/69.02
2009/0194086 A1 * 8/2009 Kempf ..... F41A 19/10 124/25
2011/0277367 A1 * 11/2011 Krieger ..... F41A 19/10 42/69.01
2014/0000578 A1 * 1/2014 Huang ..... F41B 11/70 124/72
2014/0123527 A1 * 5/2014 Calvete ..... F41A 19/41 42/51
2015/0330734 A1 * 11/2015 Kolev ..... F41A 3/12 42/69.01
2016/0348995 A1 * 12/2016 Parajon ..... F41A 19/10
2017/0059266 A1 * 3/2017 Gentilini ..... F41A 17/72

FOREIGN PATENT DOCUMENTS

FR 2534364 A1 4/1984
RU 2075024 C1 3/1997
SU 599151 A1 3/1978
SU 1199021 A1 10/1987
WO 2015030692 A1 3/2015

* cited by examiner

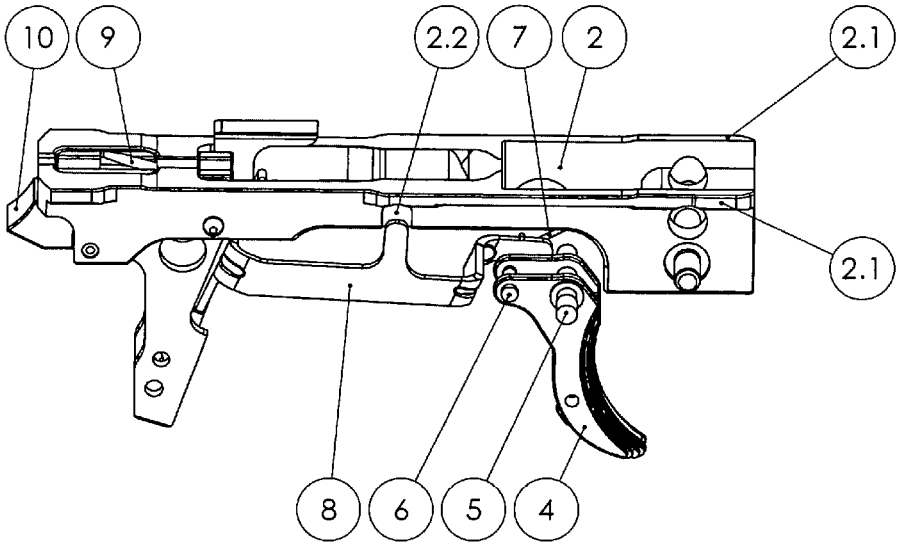
Fig. 1.1
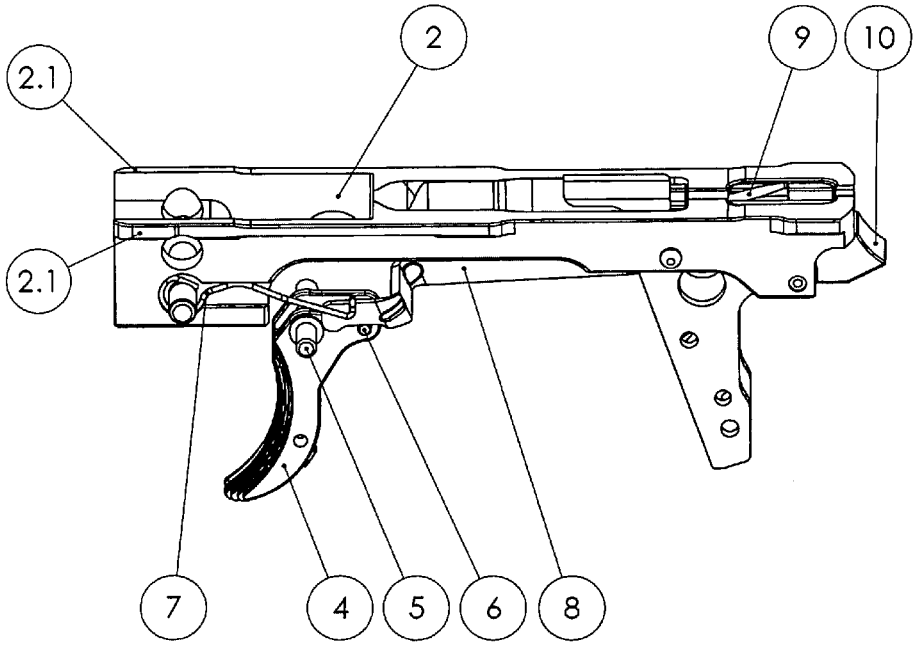
Fig. 1.2

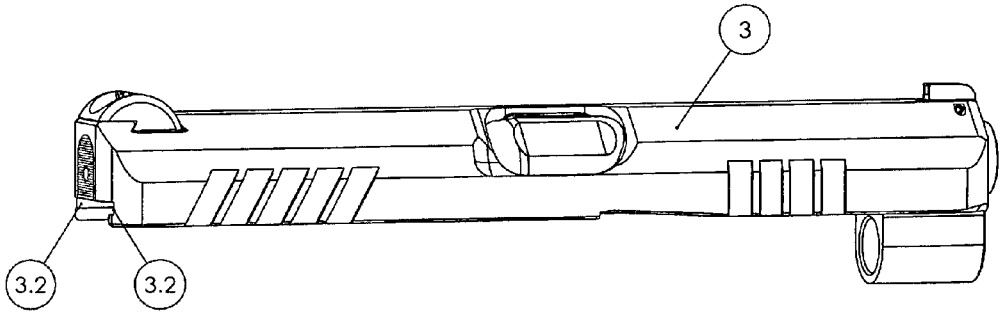
Fig. 1.3
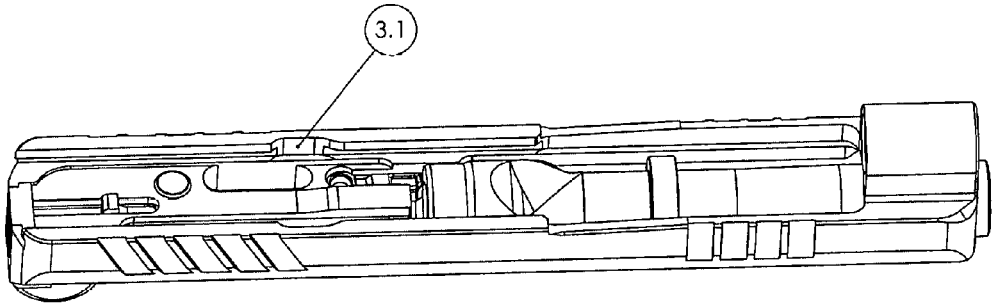
Fig. 1.4
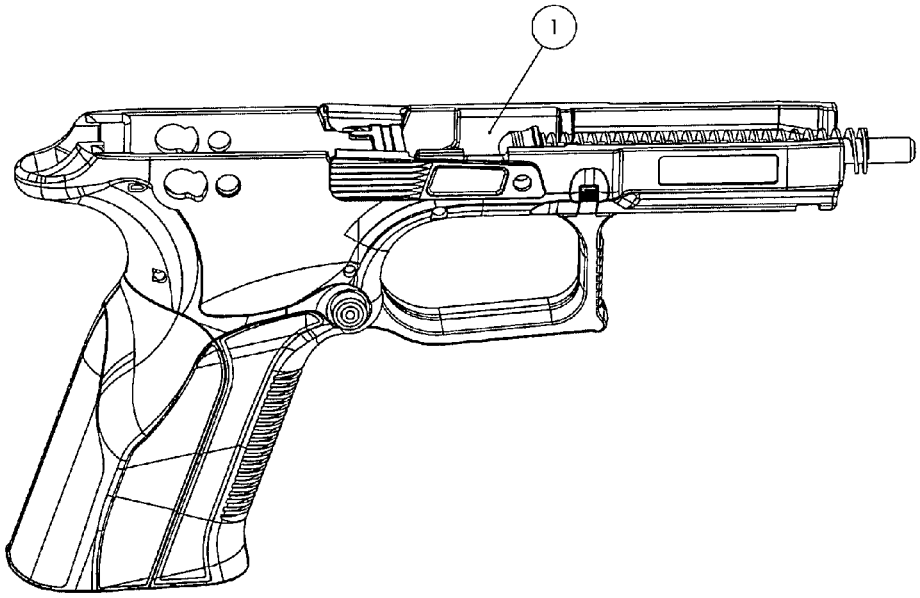
Fig. 1.5

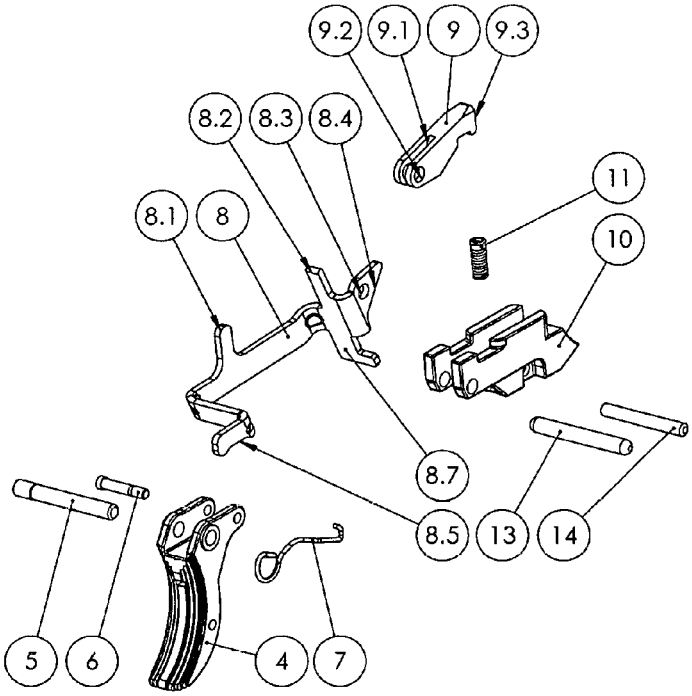
Fig. 1.6
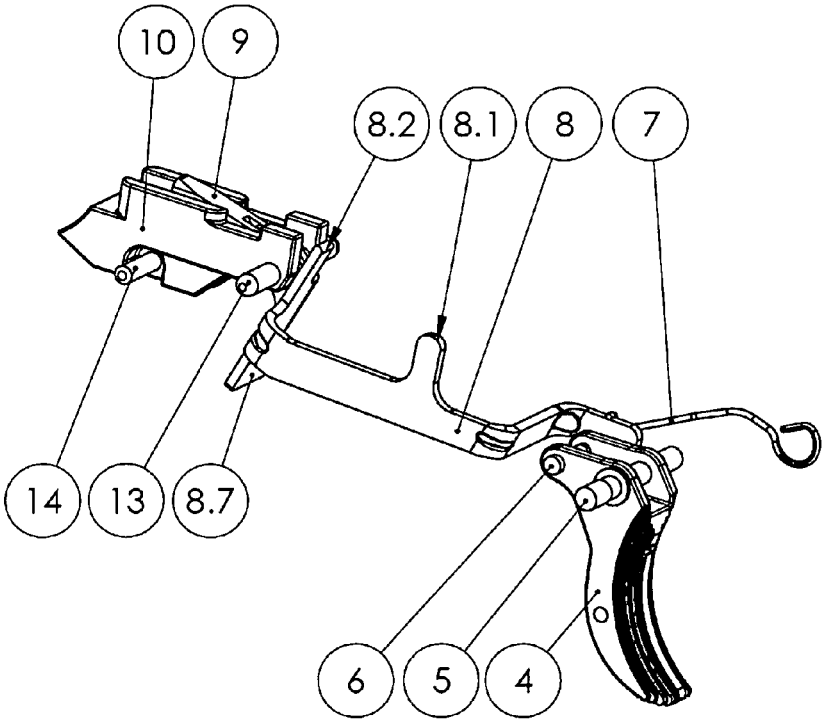
Fig. 1.7

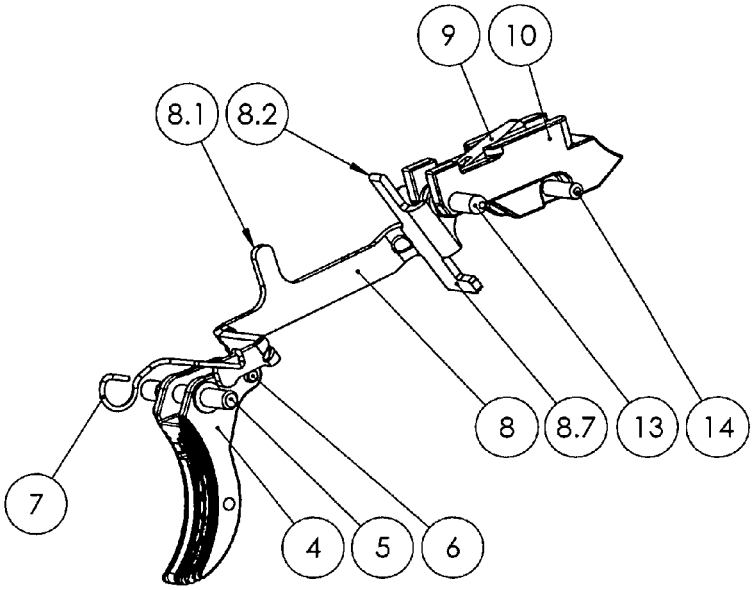
Fig. 1.8
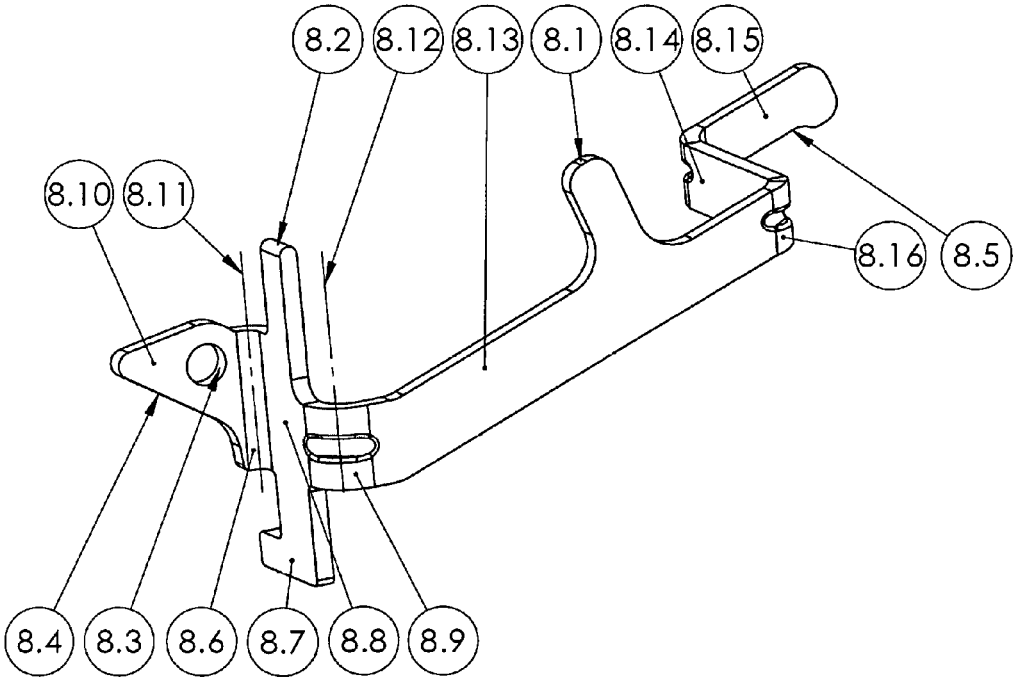
Fig. 1.9a

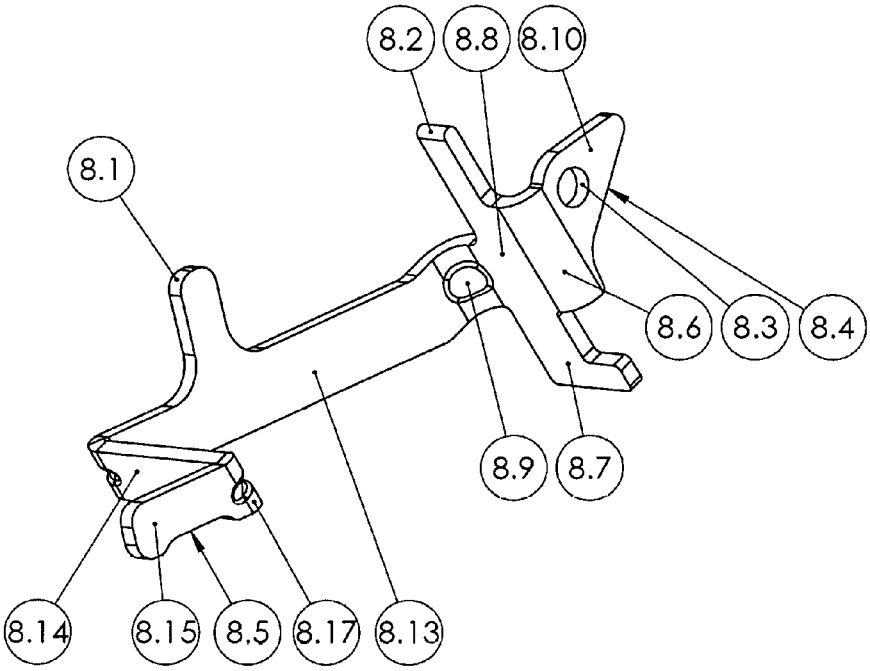
Fig. 1.9b
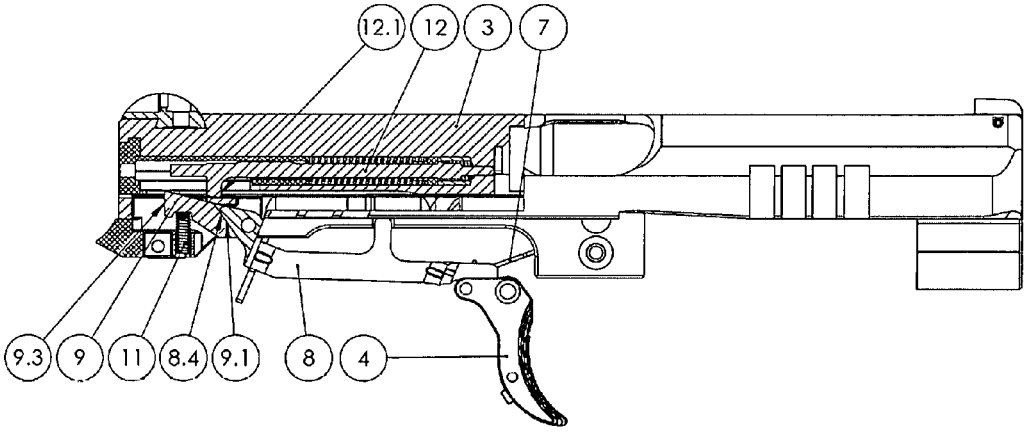
Fig. 2.1

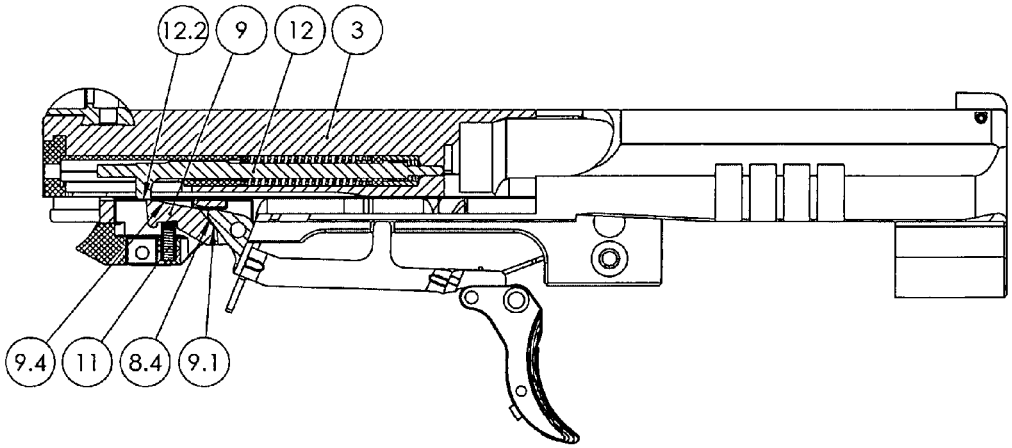
Fig. 2.2
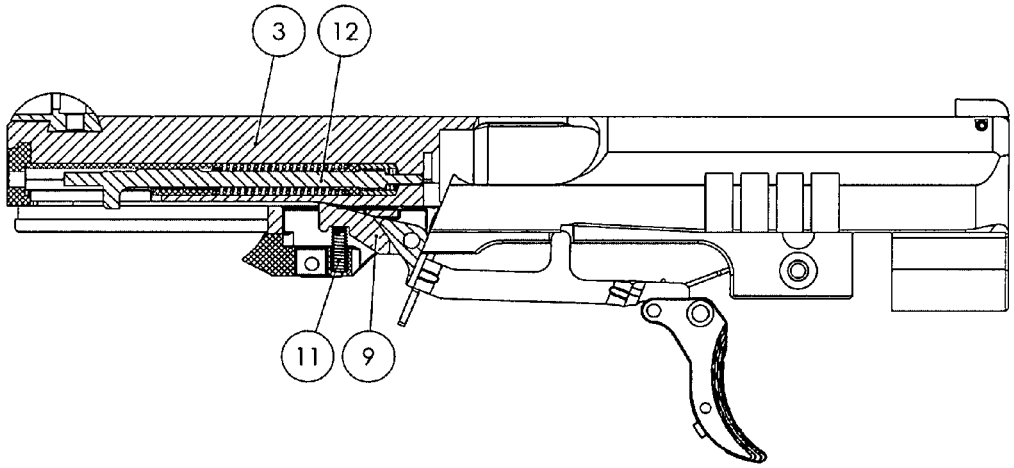
Fig. 2.3
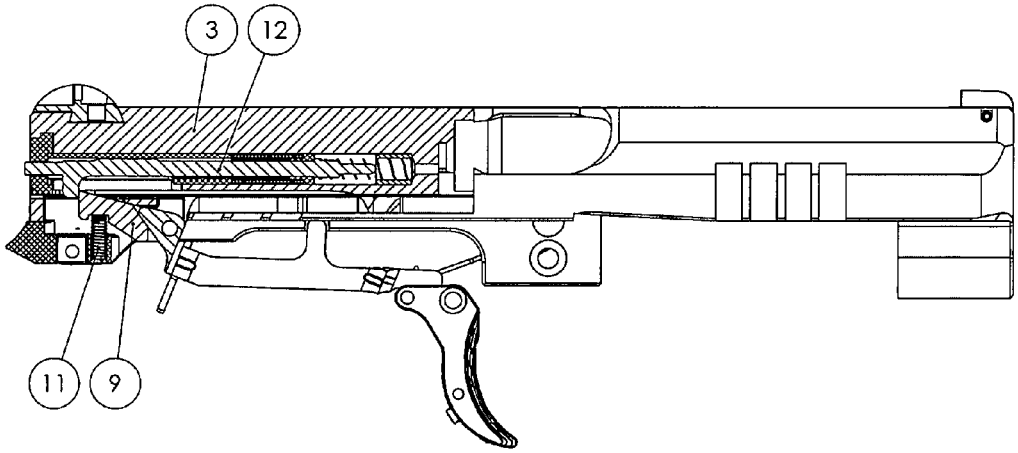
Fig. 2.4

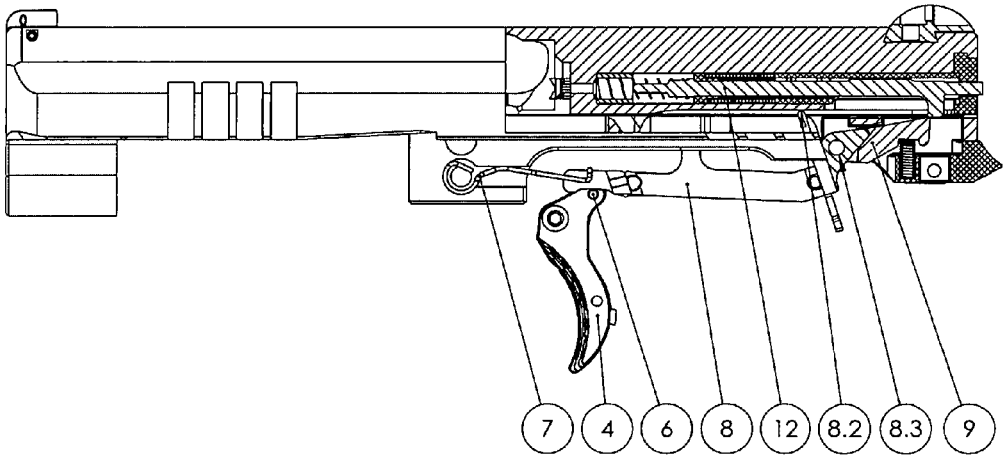
Fig. 2.5
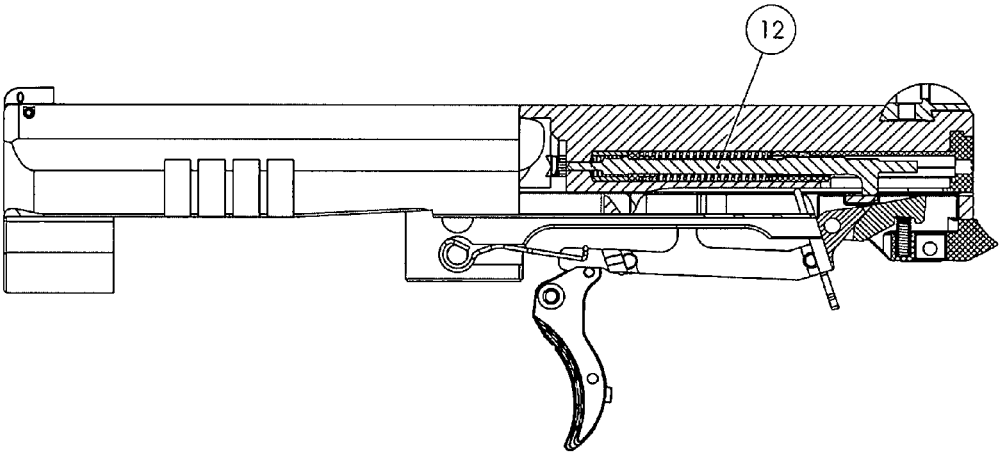
Fig. 2.6

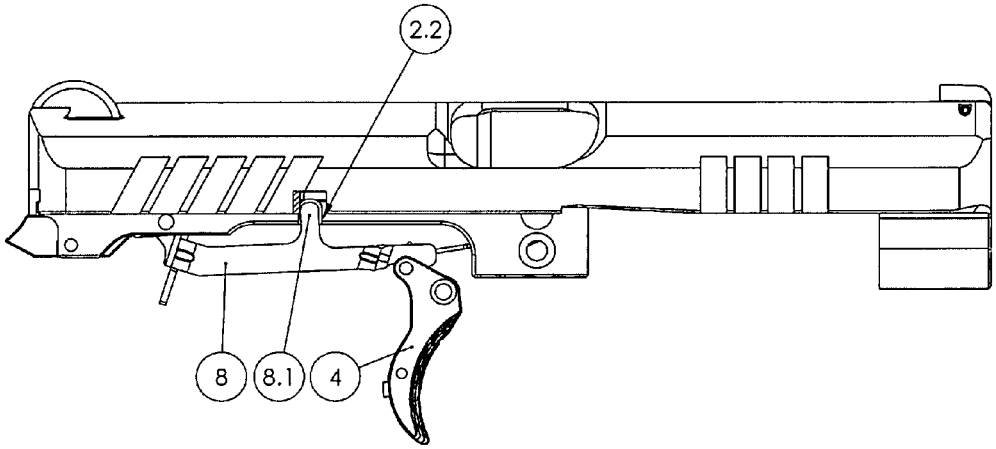
Fig. 2.7
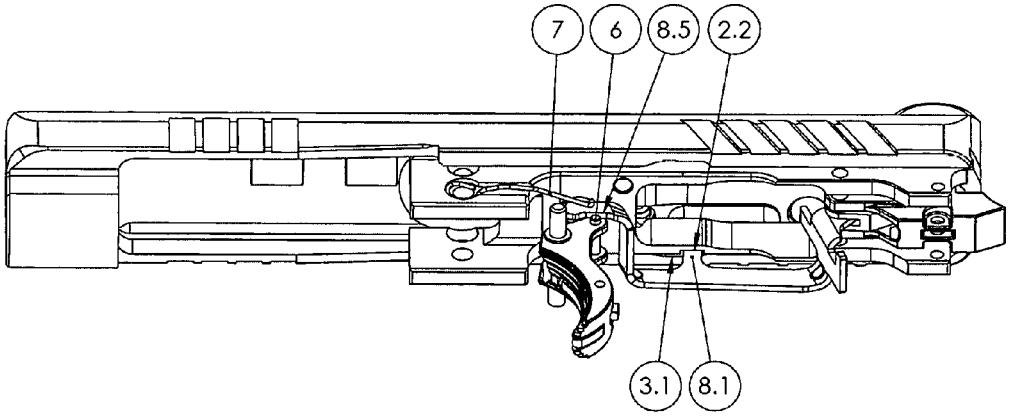
Fig. 2.7a
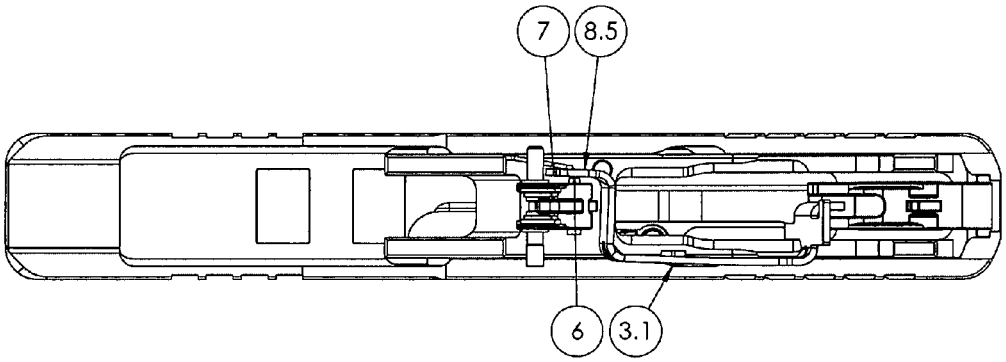
Fig. 2.8

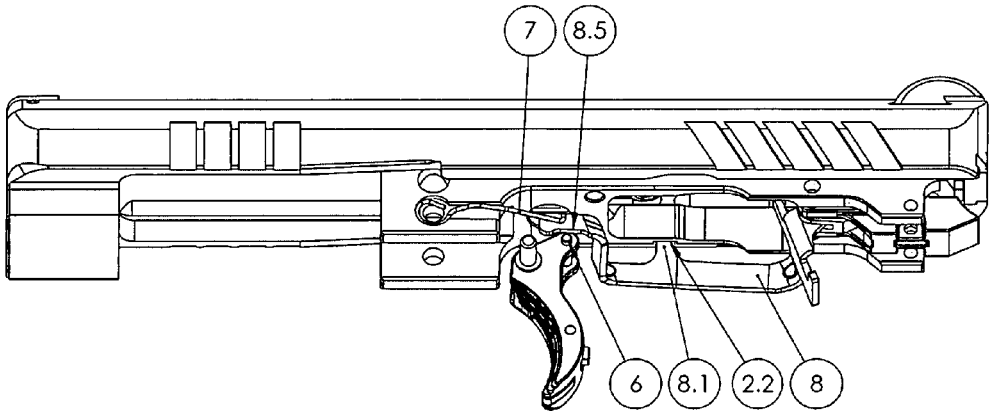
Fig. 2.8a
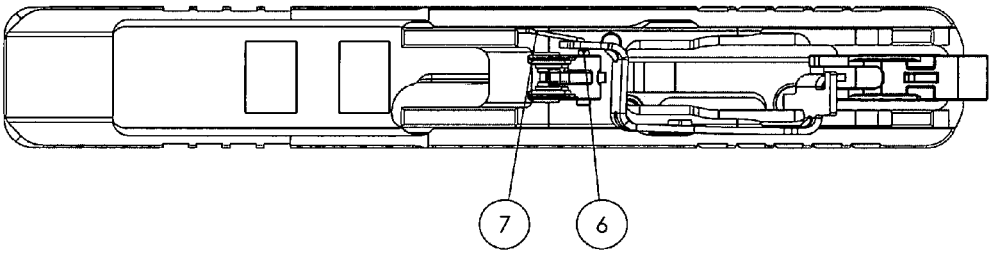
Fig. 2.9
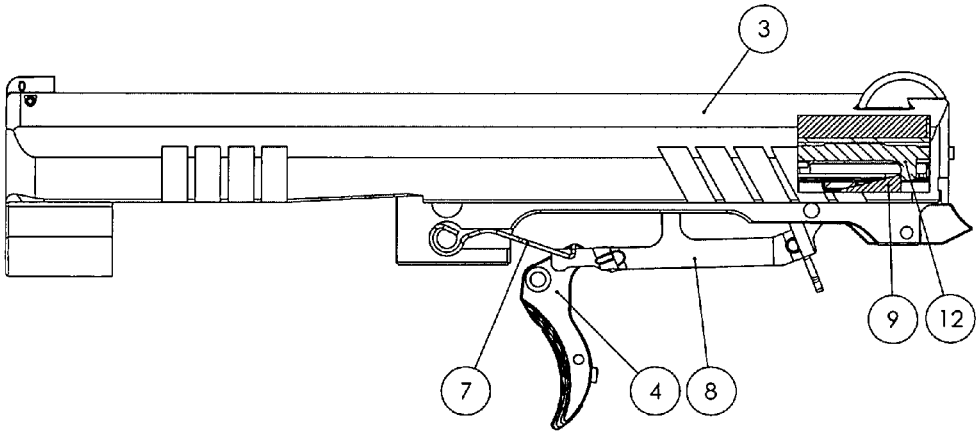
Fig. 2.9a

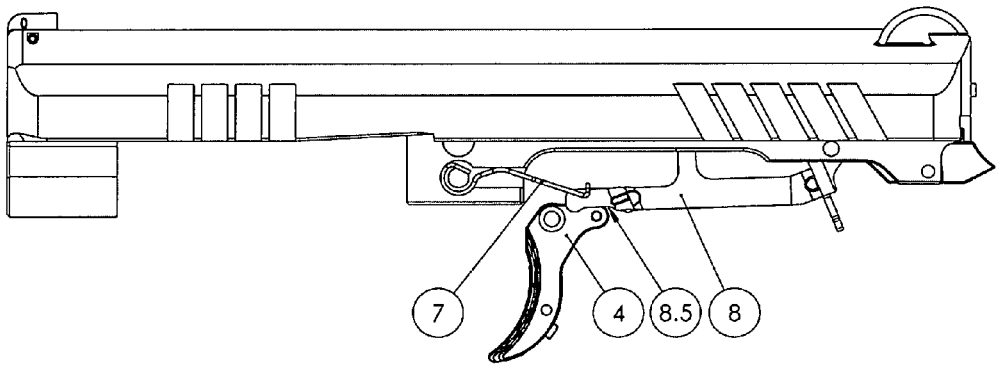
Fig. 3.1
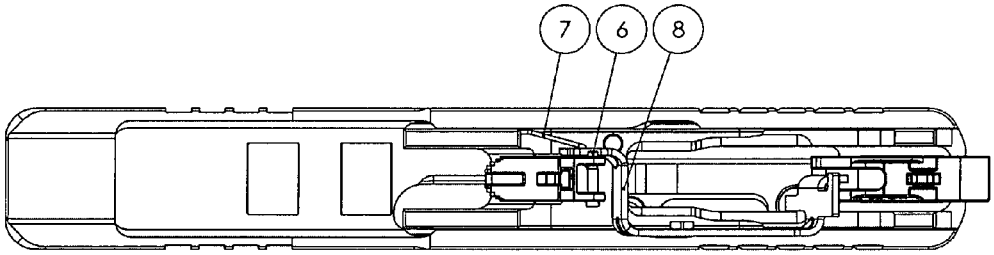
Fig. 3.1a

TRIGGER MECHANICS FOR AUTO-LOADING FIREARM WITHOUT TRIGGER MOTION BAR WITH DIRECT CONTROL OF FIRING PIN CATCH THROUGH ONE-ARM TRIGGER LEVER

BACKGROUND

1. Field of the Disclosure

The disclosure relates to the trigger mechanism for auto-loading firearm without a hammer, in which the trigger motion bar is replaced by the trigger lever. It means that different motion of said element (trigger lever) is performed upon shot and subsequent reset.

2. Discussion of the Background Art

The auto-loading firearms having the trigger mechanism equipped with one-arm or two-arm trigger moving bar are known. Both these possibilities are characterized by sliding movement upon their operation. Fixed association by the means of pin between the trigger and the trigger moving bar, irrespective whether it is one-arm or two-arm moving bar, can be considered to be their another common feature. In these cases the reset of the trigger mechanism is possible either by pushing of the entire moving bar downwards, or by deflecting of the back part of the moving bar, because its front past it is fastened with the trigger. The following variants of the trigger mechanisms are known.

CZ27296 (U1) describes a multifunctional trigger mechanism of a pistol consisting of a trigger with the turn-ably attached moving bar, into which one end of a transfer lever is inserted, which transfer lever is connected with a striking cock at its other end. Further it consists of a release holder, a cock bolder, a safety catch and necessary springs. Its subject matter lies in the fact that the other end of the transfer lever is free and widened to one side and comprises cogs. The free end of the transfer fever, having a projection against the second cog of the moving bar, is inserted into a gap in the moving bar, which gap is formed between the second and the third cog. There is a movable cock catch swing-ably positioned over the third cog. The striking cock has a triggering cog formed against, the cock catch, and the releasing cog, next to the triggering cog, against which the releasing catch is swing-ably positioned. The safeguard is running over the puller, near the cock catch and under the releasing catch, which safeguard is ended by a left small lever at the left side of the pistol and/or by a right small lever at the right side of the pistol.

US2008263926 (A1) describes a pistol including a pistol body, a slide and a trigger mechanism which includes a firing holt, a horizontal control ramp in the slide, a guide coulisse and a guide finger cooperating with the former, a control spring fastened in the pistol body and deflectable in transverse direction, and a trigger bar hinged to a trigger and cooperating with the control ramp, the guide coulisse and the control spring. The trigger fear has a catch nose retaining the firing bolt lug. To achieve enhanced smooth-running and reproducible precision with a minimum of production costs, the control spring has a disc in its upper end region; the contour of said disc being round in the plane of the trigger bar. The trigger bar has a substantially vertical catch nose in its rear end region and an edge cooperating with said disc.

The following documents belong to the prior art; SU599151 (A1), FR2534364 (A1), WO2015030692 (A1), U.S. Pat. No. 3,965,604 (A), SU1199021 (A1), RU2075024 (C1).

All of the above documents describe firearms having one end of the moving bar fastened with the trigger.

The aim of this disclosure is to make the firearm construction simpler, i.e. to reduce, the number of its parts, to make simpler its production and assembling while keeping all its advantageous functions.

SUMMARY

The trigger mechanism of the auto-loading firearm without the striking hammer, where the function of the trigger moving bar is assigned to the trigger lever, which trigger lever is not fastened with the trigger, forms the subject matter of the disclosure. For providing the shot swinging motion performed by the trigger lever is substantial. The reset of the trigger mechanism is performed by a side deflection of the front part of the trigger lever. The reset means an act needed for repeated preparation of the trigger mechanism to another shot, and is performed on the basis of the flexible deformation of the trigger lever. The trigger lever comprises a reset projection ensuring a given reset of the contact between the trigger lever and the trigger. The trigger lever comprises a hearing surface, by which it lands to a supporting pin of the trigger. The trigger comprises the supporting pin transferring the movement of the trigger to the trigger lever.

The subject matter of the present disclosure is represented by the trigger mechanism of the auto-loading firearm without a sinking hammer, with a straight-running firing pin comprising a case of the trigger lever, the trigger lever, a firing pin catch, the trigger and needed springs, wherein the firing pin catch and the trigger lever, at its rear part, are turn-ably arranged about the common rotation axis in the cave of the trigger lever, and the trigger lever, at its front longitudinal part, is freely arranged for the collaboration with the trigger. The trigger is equipped with the support pin for the collaboration with the front longitudinal part of the trigger lever, which part is pressed to the lower position by the spring of the trigger lever.

According to the preferred embodiments of the disclosure the trigger lever consists of a front longitudinal part, which is equipped with a bearing surface at its lower part, a first bending, a middle transverse part, a second bending, a long longitudinal part, a third bending, a transverse surface, a fourth bending, and a longitudinal rear part, which is equipped with a opening for hanging of the trigger lever in the case of the trigger lever, while the long longitudinal part is equipped with the first projection, and the transverse surface is equipped with the second projection in its upper part and with a downward hook.

According to the other preferred embodiment the transverse parts are approximately parallel and they are perpendicular to an imaginary plane put through the front longitudinal part. Also all longitudinal parts are approximately parallel.

The subject matter of the disclosure is represented also by the auto-loading firearm without the striking hammer, with the straight-running firing pin, which firearm consists of the firearm frame accommodating the container with the insert, in which the slide is mounted, wherein the firearm comprises the above described trigger mechanism.

According the preferred embodiment the lock is equipped with the shaped surface for the collaboration with the first projection of the trigger lever.

Reduction of the number of the required parts, simplification of the production and assembling of the firearm, quick shooter readiness, and minimal trigger resistance belong among the main advantages of this trigger mechanism.

BRIEF DESCRIPTION OF THE DRAWINGS

FIG. 1.1—right view of the container with the trigger mechanism.

FIG. 1.2—left view of the container with the trigger mechanism.

FIG. 1.3—above view of the firearm slide.

FIG. 1.4—below view of the firearm slide.

FIG. 1.4—view of the firearm handle.

FIG. 1.6—exploded scheme of the trigger mechanism.

FIG. 1.7—right view of the trigger mechanism.

FIG. 1.8—tell view of the trigger mechanism.

FIG. 1.9*a*—right detailed view of the trigger lever from the rear to the front parts.

FIG. 1.9*b*—left detailed view of the trigger lever from the front to the rear parts.

FIG. 2.1—view of the starting positions of the elements of the trigger and striking mechanisms.

FIG. 2.2—view of the positions of the elements of fee trigger mechanisms upon manual drawing of the hammer.

FIG. 2.3—view of the manual drawing with the slide in the maximal rear position.

FIG. 2.4—view of the positions of the elements of the trigger mechanisms upon, drawn striking mechanism.

FIG. 2.5—view of the positions of the elements of the trigger mechanisms upon firing.

FIG. 2.6—view of the positions of the elements of the trigger mechanisms upon striking of the firing pin on the projectile.

FIG. 2.7—below view of the positions of the elements of the trigger mechanisms upon striking of the firing pin.

FIG. 2.7*a*—angled below view of the positions of the elements of the trigger mechanisms upon striking of the firing pin.

FIG. 2.8—view of the positions of the elements of the trigger mechanisms upon resetting of the trigger.

FIG. 2.8*a*—angled below view of the positions of the elements of the trigger mechanisms upon resetting of the trigger.

FIG. 2.9—view of the trigger lever of the mechanism in the starting position after tire reset.

FIG. 2.9*a*—view of the positions of the elements of the trigger mechanisms after resetting and with the drawn trigger.

FIG. 3.1—view of the released trigger.

FIG. 3.1*a*—below view of the elements of the trigger mechanisms in the starting position, with the drawn firing pin and the trigger mechanisms prepared for the next shot.

DETAILED DESCRIPTION OF THE PREFERRED EMBODIMENT

Example 1

FIGS. 1.1 and 1.2 illustrate right and left view of the container of the auto-loading firearm with the trigger mechanism, respectively. The individual parts are accommodated in the insert 2, which is equipped with the guides 2.1 enabling the sliding of the slide 3 on it. The insert 2 is positioned in the plastic frame 1 of the firearm (FIG. 1.5). The trigger 4 is hanged on the trigger pin 5, which pin is engaged in the plastic frame 1 of the firearm. The trigger 4 is further equipped with the supporting trigger pin 6. The trigger mechanism is further equipped with the trigger lever 8 and the firing pin catch 9. The trigger lever 8 and the firing pin catch 9 are accommodated in the case 10 of the trigger lever by the means of the pin.

FIGS. 1.3 and 1.4 illustrate the firearm slide 3. Slide guides 3.2 work as the sliding connection with the insert 2 by the means of the guides 2.1 of the insert. Slide 3 of the firearm is equipped with the shaped surface 3.1 working as the trigger reset, and in the same time it functions as a disassembling position of the firearm.

FIG. 1.5 illustrates the plastic frame 1 of the firearm, accommodating the entire container, including the trigger mechanism.

FIG. 1.6 illustrates the individual functional and contact surfaces of all elements of the trigger mechanism consisting of the case 10 of the trigger lever accommodating the trigger lever 8 and the firing pin catch 9, and further comprises the spring 7 of the trigger lever, and the spring 11 of the firing pin catch. FIG. 1.7 is a right view of the trigger mechanism illustrated in FIG. 1.6. FIG. 1.8 is a left view of the trigger mechanism illustrated in FIG. 1.6. Components of both FIG. 1.7 and FIG. 1.8 can be found and are described in FIG. 1.6. FIGS. 1.8 and 1.8 show that the components, or some of these components, are mechanically assembled.

Position of the case 10 of the trigger lever is secured by the sideboard pin 13 and the stabilization pin 14 of the trigger lever case and thus also the position of the entire container in insert 2 is secured. The trigger lever 8 is equipped with the bearing surface 8.5 at its front part, the first projection 8.1, the second projection 8.2, the opening 8.3, and the surface 8.4 at its rear part. See FIGS. 1.9*a* and 1.9*b* for more detailed description of the trigger lever 8.

The bearing surface 8.5 of the trigger lever ensures reliable jumping of the supporting trigger pin 6 under the opening front part of the trigger lever 8. The first projection 8.1 of the trigger lever functions as the trigger 4 reset and it is controlled by the shaped surface 3.1 in the slide 3 (FIG. 2.7). The role of the second projection 8.2 of the trigger lever is to control the falling safeguard. The opening 8.3 enables the hanging of the trigger lever 8 in the case 10 of the trigger lever and subsequently in the insert 2, the trigger lever 8 is swing-ably connected with the firing pin catch 9, and the surface 8.4, at the rear part of the trigger lever 8, is in light contact with the firing pin catch surface 9.1, and they represent the functional surfaces (8.4, 9.1). The contact between these functional surfaces 8.4 and 9.1 is interrupted only during the manual or automatic drawing of the striking mechanism (firing pin). The firing pin catch 9 comprises the surface 9.1, the rear surface 9.3, the upper surface 9.4 (FIG. 2.2), and the opening 9.2. The rear surface 9.3 of the firing pin catch works as the bearing surface and supports the firing pin in its drawn state.

The trigger lever 8 illustrated on FIGS. 1.9*a* and 1.9 *b* consists of one metal part formed by bending, and comprises one front longitudinal part 8.15 equipped with the bearing surface 8.5 at its lower side, the first bending 8.17 followed by the first transverse part 8.14, the second bending 8.16, and the long longitudinal part 8.13 equipped with the fist projection 8.1. The long longitudinal part 8.13 ends with the third bending 8.9 followed by the second transverse part 8.8 equipped with the second projection 8.2 at its upper part for controlling of the falling safety lock, and with a hook 8.7 in the downward direction for engaging the palm safety lock. There is the forth bending 8.6 after the transverse surface, and the trigger lever ends with the longitudinal rear part 8.10 equipped with the opening 9.3 for hanging of the trigger lever 8, and the surface 8.4 in the rear lower part for pressing of the firing pin catch to its lower position. Longitudinal parts 8.15, 8.13, and 8.10 are approximately parallel. The first and second transverse parts 8.14 and 8.8 are approximately parallel to each other and they are perpendicular to the imaginary plane put through the front longitudinal part 8.15. All bendings, except the fourth bending 8.6, are reinforced by embossed surfaces. The first and the second bending lines 8.11 and 8.12 are positioned transversely to the bendings 8.6 and 8.9.

The bullet is fired after drawing of the trigger 4 hanged on the trigger pin 5 accommodated in the plastic frame 1 of the firearm. The longest longitudinal part 8.13 of the trigger lever is flexibly deformable and thus enables working of the trigger mechanism. The trigger 4 is further equipped with the supporting trigger pin 6 for lifting of the trigger lever 8 after pulling of the trigger 4. Swing motion of the trigger lever 8 is subsequently transferred to the firing pin catch 9. The trigger lever 8 and the firing pin catch 9 are swing-ably accommodated in the case 10 of the trigger lever by the means of the pin 13. The reliable return of the trigger lever 8 to the starting position is provided by the spring 7 of the trigger lever. The milled groove 2.2 in the insert 2 is needed for the trigger 4 reset and its function will be explained below.

Example 2

Drawing

FIGS. 2.1, 2.2, 2.3, 2.4

FIG. 2.1 illustrate the trigger mechanism in its inactive state with the slide 3 in the front position and the lowered firing pin 12. The firing pin 12 has a cog 12.2 (FIG. 2.2) with the functional surface 12.1 (FIG. 2.1) for collaboration with the rear surface 9.3 of the firing pin catch. All elements of the trigger mechanism are present in their starting positions. The trigger 4 is present in its front position. The trigger lever 8 is pushed into its lower position both by the spring 7 of the trigger lever, and by the firing pin catch 9, which catch is pushed to its starting upper position by the spring 11 of the firing pin catch. Functional surfaces 8.4 and 9.1 are in contact. Upon lowering of the firing pin 12 the functional surface 12.1 of the firing pin cog is propped on the firing pin catch 9.

FIG. 2.2 illustrate the process of the initial loading by the manual drawing, as well as the process of the automatic drawing. The firing pin 12 is carried by the slide 3 during its movement to the rear position. When the cog 12.2 of the firing pin comes to the needed level, it presses on the upper surface 9.4 of the firing pin catch overcoming the resistance of the spring 11 of the firing pin catch and presses the firing pin catch 9 sufficiently low so that the cog 12.2 of the firing pin comes into she space behind the firing pin catch 9.

FIG. 2.3 illustrates the slide 3 in its maximal rear position. The firing pin 12 is in the space behind the firing pin catch 9, which catch is pushed from its starting position by the spring 11.

FIG. 2.4 illustrates the firearm slide 3 in its front starting position. All components of the trigger mechanisms are present in their starting positions except the firing pin 12, which is drawn, i.e. propped on the firing pin catch 9. The functional surface 12.1 (FIG. 2.1) of the firing pin cog is propped on the rear surface (FIG. 2.1) of the firing pin catch. In this position the firearm is prepared for the firing.

Example 3

Firing

FIG. 2.5, FIG. 2.6, FIG. 27, FIG. 2.7*a*, FIG. 2.8. FIG. 2.8*a*, FIG. 2.9, FIG. 2.9*a*, FIG. 3.1 and FIG. 3.1*a*.

FIG. 2.5 illustrates the firing itself. The pressure on the trigger 4, which is in its rear position, is through the supporting trigger pin 6 transferred to the trigger lever 8 in the area of the shaped surface 8.5 of the trigger lever and it presses the front longitudinal part 8.15 of the trigger lever to its upper position. Upon this motion the resistance of the spring 7 of the trigger lever is overcome. The trigger lever swings, while the center of the rotation of this swinging motion is in the opening 8.3 of the trigger lever. Thus, behind the center of the rotation the firing pin catch 9 is pressed into its lower position and it results in the releasing of the drawn firing pin 12. By lifting of the second projection 8.2 of the trigger lever the failing safeguard is also unblocked.

FIG. 2.6 illustrates the moving of the firing pin 12 after releasing to the front position.

FIGS. 2.7 and 2.7*a* illustrate the function of the trigger reset. The trigger 4 reset is the act needed for the re-preparation of the trigger mechanism for the next shot after the previous one. The trigger 4 is retracted in its rear position and the front part of the trigger lever 8 is pulled into its upper position through the supporting trigger pin 6. The supporting trigger pin 6 of the trigger is in contact with the bearing surface 8.5 of the trigger lever, which lever is pressed to the supporting trigger pin 6, by the spring 7 of the trigger lever. In this case the first projection 8.1 of the trigger lever is sufficiently high to reach the level of the shaped surface 3.1 of the slide, with which it is not in contact in that moment.

Drilled groove 2.2 of the insert forming the space for the first projection 8.1 of the trigger lever—reseter, is visible on FIGS. 2.7 and 2.8.

FIGS. 2.8 and 2.8*a* illustrate the reset of the trigger mechanism according to the present disclosure. Upon setting off the bullet the gases are expanded, which gases tent to press the lock 3 into its rear position. It is clear that also the shaped surface 3.1 of the slide is moved during this movement. During its movement the inclination of the surface 3.1 with arc-shape continually presses the first projection 8.1 of the trigger lever, i.e. the reseter, towards the slide 3 axis, which slide falls into the drilled groove 2.2 of the insert. This act results in the flexible deformation and deflection of the whole front part of the trigger lever 8 to the left side in the shooter's view. At the moment, when the trigger lever 8 is sufficiently deflected to the side and thus losing the support of the supporting trigger pin 6, and by the action of the force of the spring 7 of the trigger lever, the trigger lever 8 is pressed into its lower position.

It is clear from FIGS. 2.9 and 2.9*a* that, in spite of the feet that the trigger lever 8 is in its lower position, it is still side-deflected, because the trigger 4 with the supporting trigger pin 6 is drawn, i.e. it is in its rear position. Thus the trigger lever 8 is by the side wall in its front part propped on the trigger supporting pin 6, and by the means of both its own flexibility and the force of the spring 7 of the trigger lever presses on the side of the supporting trigger pin 6. Since after the reset the trigger lever 8 and the firing pin catch 9 of the firing pen came back to their starting positions and the slide 3 with the firing pin 12 was pressed by the expanding gases into its rear position, the firing pin 12 was re-drawn.

Therefore, it is clear from FIGS. 3.1 and 3.3*a* that also the releasing of the trigger 4 to its front starting position is needed for the next shot. This act will enable the supporting trigger pin 6 to come under the bearing surface 8.5 of the trigger lever. Subsequently the trigger lever 8, by the means of its own flexibility and strength of the spring 7 of the trigger lever acting on the right side in shooter's view, is returned from its deflected position back to its starting position over the supporting trigger pin 6. Therefore it is clear that the spring 7 of the trigger lever imposes the force in two axes. By this act the trigger mechanism is fully prepared for another shot.

LIST OF THE REFERENCE SIGNS

1—plastic frame of the fire arm
2—insert
2.1—insert guide
2.2—milled insert groove
3—firearm slide
3.1—shaped slide surface
3.2—slide guide
4—trigger
5—trigger pin
6—supporting trigger pin
7—spring
8—trigger lever
8.1—first projection of the trigger lever—reset projection
8.2—second projection of the trigger lever
8.4—surface at the rear part of the trigger lever
8.5—hearing surface of the trigger lever
8.6—fourth bending
8.7—hook
8.8—second transverse part
8.9—third bending
8.10—longitudinal rear part
8.11—first bending line
8.12—second bending line
8.13—long longitudinal part
8.14—first transverse pan
8.15—front longitudinal part
8.16—second bending
8.17—first bending
9—firing pin catch
9.1—surface of the firing pin catch
9.2—opening of the firing pin catch
9.3—rear surface of the firing pin catch
9.4—upper surface of the firing pin catch
10—case of the trigger lever
11—spring
12—firing pin
12.1—functional surface of the cog of the firing pin
12.2—cog of the firing pin
13—sideboard pin of the trigger lever
14—stabilization pin of the trigger lever

What is claimed is:

1. A trigger mechanism of an auto-loading firearm without a striking hammer, with a straight-running firing pin, which comprises:

a case of a trigger lever;
a trigger lever;
a firing pin catch;
a trigger equipped with a supporting trigger pin; and
a spring of the trigger lever;

wherein the trigger lever is flexibly deformational and comprises a front longitudinal part, a rear longitudinal part and a first projection for reset of a contact between the trigger lever and the trigger;

the firing pin catch and the rear longitudinal part of the trigger lever are turnably arranged around a common rotation axis in the case of the trigger lever;

the front longitudinal part is equipped with a bearing surface at its lower part, by which the trigger lever lands on the supporting trigger pin;

the front longitudinal part is pressed to its lower position by the spring of the trigger lever;

after firing the trigger is retracted in its rear position and the front longitudinal part of the trigger lever is deflected due to the flexible deformation of the trigger lever such that the trigger lever is by a side wall of the front longitudinal part propped on, and by the means of both the flexibility of the trigger lever and by the force of the spring of the trigger lever pressed against, the side of the supporting trigger pin;

wherein the longitudinal direction is parallel along the longitudinal axis of the firearm.

2. The trigger mechanism according to claim 1, wherein the trigger lever consists of:

the front longitudinal part, which is equipped with the bearing surface at its lower part;
a first bending;
a first transverse part, wherein the transverse direction is perpendicular to longitudinal;
a second bending;
a deformable long longitudinal part equipped with the first projection for resetting the trigger;
a third bending;
a second transverse part equipped with a second projection at its upper part for controlling of the falling safety lock, and with a hook in the downward direction for engaging the palm safety lock;
a fourth bending; and
the longitudinal rear part, which is equipped with an opening for hanging of the trigger lever in the case of the trigger lever.

3. The trigger mechanism according to claim 2, wherein the first and the second transverse parts are approximately parallel and perpendicular to an imaginary plane through the front longitudinal part; and the longitudinal parts are approximately parallel.

4. An auto-loading firearm without a striking hammer and directly running striker, comprising an firearm frame accommodating a container with an insert where a firing pin is accommodated, while the insert is equipped with guides, onto which a slide slides, wherein it comprises the trigger mechanism according claim 1.

5. The auto-loading firearm according to claim 4, wherein the slide is equipped with a shaped surface for collaboration with a first projection of the trigger lever.

6. The trigger mechanism according to claim 1, wherein the rear longitudinal part of the trigger lever is equipped with a functional surface, and the firing pin catch is equipped with a functional surface, wherein the functional surface of the rear longitudinal part is in tight contact with the functional surface of the firing pin catch.

7. An auto-loading firearm without a striking hammer and directly running striker, comprising a firearm frame accommodating a container with an insert where a firing pin is accommodated, while the insert is equipped with guides, onto which a slide slides, wherein it further comprises a trigger mechanism that comprises:

a case of a trigger lever;
a trigger equipped with a supporting trigger pin, the trigger is hanged on a trigger pin accommodated in the plastic frame of the firearm;

a trigger lever that consists of:

a front longitudinal part, which is equipped with a bearing surface at its lower part, by which the trigger lever lands on the supporting trigger pin;

a first bending;

a first transverse part;

a second bending;

a flexibly deformable long longitudinal part equipped with the first projection for resetting the trigger;

a third bending;

a second transverse part equipped with a second projection at its upper part for controlling of the falling safety lock, and with a hook in the downward direction for engaging the palm safety lock;

a fourth bending; and a longitudinal rear part, which is equipped with a functional surface and an opening for hanging of the trigger lever in the case of the trigger lever;

a firing pin catch equipped with a functional surface, wherein the functional surface of the longitudinal rear part is in tight contact with the functional surface of the firing pin catch;

a spring of the trigger lever for pressing the front longitudinal part into a lower position; and a spring of the firing pin catch for pushing the firing pin catch into an upper position;

the firing pin catch and the rear longitudinal part of the trigger lever, are swingable arranged around the common rotation axis in the case of the trigger lever;

after firing the trigger is retracted in its rear position and the front longitudinal part of the trigger lever is deflected due to the flexible deformation of the trigger lever such that the trigger lever is by a side wall of the front longitudinal part propped on and, by the means of both the flexibility of the trigger lever and by the force of the spring of the trigger lever, pressed against the side of the supporting trigger pin; and the slide is equipped with a shaped surface for collaboration with the first projection of the trigger lever.

* * * * *